United States Patent [19]

Mayes

[11] 4,203,826

[45] May 20, 1980

[54] PROCESS FOR PRODUCING HIGH PURITY AROMATIC COMPOUNDS

[75] Inventor: Warden W. Mayes, Big Spring, Tex.

[73] Assignee: Cosden Technology, Inc., Big Spring, Tex.

[21] Appl. No.: 827,356

[22] Filed: Aug. 24, 1977

[51] Int. Cl.[2] ..... C10G 35/04

[52] U.S. Cl. ..... 208/64; 208/65; 208/134; 208/138; 585/407

[58] Field of Search ..... 208/64, 65, 134; 260/673.5; 585/407

[56] References Cited

U.S. PATENT DOCUMENTS

| | | | |
|---|---|---|---|
| 3,499,945 | 3/1970 | Kirk | 260/673.5 |
| 3,635,815 | 1/1972 | Kuchar | 208/134 |

*Primary Examiner*—C. Davis

*Attorney, Agent, or Firm*—Schwartz, Jeffery, Schwaab, Mack, Blumenthal & Koch

[57] ABSTRACT

High-purity $C_7$ and/or $C_8$ aromatic hydrocarbons are produced by reforming a $C_7$ or $C_8$ full boiling carbon number naphtha feed fraction or combinations thereof under reforming conditions of sufficient severity to convert essentially all of the non-aromatic portion of the naphtha feed boiling in the $C_7$ to $C_8$ aromatic boiling range to $C_7$ and/or $C_8$ aromatics, and then separating the reformate by fractional distillation into high-purity fractions of $C_7$ and/or $C_8$ aromatic hydrocarbons. Preferably, the $C_7$ and/or $C_8$ full boiling carbon number naphtha feed fraction is reformed in a plurality of reformer reaction stages with increasingly more severe conditions in order to maximize the yield of the $C_7$ and $C_8$ aromatics.

17 Claims, 2 Drawing Figures

HIGH PURITY $C_8$ AROMATIC HYDROCARBONS
RERUN COLUMN
$C_9^+$
DENEPTANIZER COLUMN
REFORMING ZONE
LOW-BOILING HYDROCARBONS
$C_6$ AROMATIC HYDROCARBONS
HIGH PURITY $C_7$ AROMATIC HYDROCARBONS
FEED SPLITTER
TO HEAVY MOTOR FUEL REFORMER
CRUDE TOWER
FEED
31
32
33
34
35
36
37
38
39
40
41
42
43
44
45
46
47
48
49
50
51

PROCESS FOR PRODUCING HIGH PURITY AROMATIC COMPOUNDS

BACKGROUND OF THE INVENTION

The present invention relates to a process for the preparation of $C_7$ and/or $C_8$ aromatic hydrocarbons of high purity. More particularly, the present invention provides a process for the production of toluene, having an aromatic hydrocarbon purity of greater than 95 liquid volume percent, and/or mixed xylenes having an aromatic hydrocarbon purity of greater than 99 liquid volume percent, by treatment of petroleum feed fractions wherein the conventional costly solvent extraction step is completely eliminated, and wherein the yield of these $C_7$ and/or $C_8$ aromatic hydrocarbons, per volume of crude petroleum feed, is greatly increased over that obtained with conventional processes.

$C_7$ and/or $C_8$ aromatic hydrocarbons of high purity have many essential uses in the chemical industry. It is well known that these hydrocarbons can be formed from the naphthene and/or paraffin hydrocarbons occurring in the naphtha sources, such as from cracking, etc., by catalytic reforming of petroleum fractions under conditions effective to remove hydrogen atoms from the naphthene rings and other reforming type reactions to thereby convert them to aromatic compounds. However, in conventional high severity reforming operations, significant quantities of these nonaromatic compounds are not substantially converted to aromatics. These unconverted nonaromatic compounds boil within the respective $C_7$ and/or $C_8$ aromatic hydrocarbon boiling range, and therefore cannot be separated from the aromatic hydrocarbon product by low-cost fractional distillation without also utilizing high-cost solvent extraction. Reforming of naphtha fractions by conventional processes, therefore, produces a $C_7$ and/or $C_8$ aromatic hydrocarbon product containing a significant quantity of difficultly removable nonaromatic material. Accordingly, in order to produce a $C_7$ and/or $C_8$ aromatic hydrocarbon of commercial quality, it is conventional to subject the resulting reformate to a costly solvent extraction step in order to obtain a high-purity $C_7$ and/or $C_8$ aromatic hydrocarbon. Due to the higher cost attendant solvent extraction, including the greater energy requirement therefor, efforts have been made to develop processes for the production of aromatic hydrocarbons which do not require a solvent extraction step in order to produce a product of commercially acceptable quality.

Several processes have been developed for the production of $C_7$ and/or $C_8$ aromatic hydrocarbons of commercial purity which dispense with solvent extraction. Typically, this result has been achieved by employing as the reformer charge fraction a hydrocarbon heartcut containing only those aromatic precursors which have a lower boiling point than the aromatics to be produced therefrom, in order to allow the facile separation of the unconverted nonaromatic material and the $C_7$ and/or $C_8$ aromatic hydrocarbons. For example, in U.S. Pat. No. 3,635,815, a naphtha feed fraction is prefractionated into an overhead fraction having an upper endpoint of 270° F. to 275° F. (ASTM) and a bottom fraction having a higher endpoint. The overhead fraction is then catalytically reformed under reforming conditions of sufficient severity to convert the lower boiling naphthenes and paraffins to $C_8$ aromatic which boils above the major part of the heartcut. The resulting reformate is then subjected to a plurality of fractionation steps to produce a mixture of high-purity $C_8$ aromatic hydrocarbons.

Similarly, in U.S. Pat. No. 3,499,945, a petroleum naphtha fraction is fractionated to produce a $C_7$ containing heartcut boiling between about 175° and 220° F. The boiling point of this heartcut is significantly less than the 231° F. boiling point of toluene. The $C_7$ heartcut is reformed to convert toluene precursors, such as the $C_7$ naphthenes, into toluene, yielding a reformate which is distilled to produce a fraction rich in toluene, but also containing paraffins. High severity thermal cracking, fractionation, and clay treatment of the toluene rich fraction then yields a high-purity toluene product.

U.S. Pat. No. 2,653,175 describes a split-feed reforming process for the preparation of aromatic hydrocarbons in which a petroleum feed is separated into a $C_6$ and $C_7$ naphthene heartcut, and a $C_8$ naphthene heartcut. Each heartcut is separately reformed and separated from similar boiling paraffins by contact with an aromatic selective absorbent.

While the above processes produce $C_7$ and/or $C_8$ aromatic hydrocarbons of adequate purity, these processes possess certain disadvantages which render their use undesirable. In each of the above processes, the petroleum feed fraction is prefractionated into very narrow boiling range heartcuts in order to remove the nonaromatic material which boils within the boiling range of the aromatic to be produced from the feed. Prefractionation of the petroleum feed fraction into such very narrow boiling range fractions, however, removes significant quantities of $C_7$ and/or $C_8$ aromatic precursors from the conversion process and correspondingly reduces the yield of $C_7$ and/or $C_8$ aromatic hydrocarbons per volume of petroleum feed. These prior art processes, therefore, achieve increased purity of the aromatic product at the expense of yield.

It is also known in the art that a two-step reforming process may be employed for the production of aromatic hydrocarbons in which a naphtha feed is reformed under mild conditions in a first step and then subjected to thermal cracking in a second step. Hitherto, however, even with the use of such a reforming procedure in conventional processes, $C_7$ and/or $C_8$ aromatic hydrocarbons of less than desirable purity have been obtained. For example, in U.S. Pat. No. 3,499,945, the combination of a prefractionation step and a two-step reforming process fails to achieve a toluene product of commercially acceptable purity without a subsequent clay treatment purification step.

In view of our ever declining supplies of petroleum, the low yields per volume of petroleum feed and/or low aromatic purities obtained with the above processes renders their use undesirable. Accordingly, there exists a great need in the art for a process for the manufacture of high-purity $C_7$ and/or $C_8$ aromatic hydrocarbons which eliminates the necessity for costly solvent extraction and which produces a product of commercially acceptable purity with a maximum yield per volume of petroleum feed.

SUMMARY OF THE INVENTION

Accordingly, it is an object of the instant invention to provide a process for the manufacture of high-purity $C_7$ and/or $C_8$ aromatic hydrocarbons.

It is another object of the present invention to provide a process for the production of high-purity $C_7$ and/or $C_8$ aromatic hydrocarbons without the necessity for solvent extraction.

Still another object of the instant invention is the provision of a process for the production of high-purity $C_7$ and/or $C_8$ aromatic hydrocarbons which maximizes the yield of aromatic hydrocarbons obtainable from each volume of petroleum feed.

Is is a specific object of the present invention to provide a process for the production of high-purity toluene, and mixed xylenes, wherein a product of commercially acceptable purity can be produced without costly solvent extraction, and wherein the yield of these aromatic hydrocarbons per volume of petroleum feed is maximized.

It is a further object of the instant invention to provide a process for the production of high-purity $C_8$ aromatic hydrocarbons having an aromatic hydrocarbon purity of greater than 99 liquid volume percent.

Still another object of the instant invention is to provide a process for the production of high-purity $C_7$ aromatic hydrocarbons having an aromatic purity of greater than 95 liquid volume percent.

In accomplishing the foregoing and other objects, there has been provided in accordance with the present invention a process for the production of high-purity commercial quality $C_7$ and/or $C_8$ aromatic hydrocarbons in high yields from a naphtha feed fraction containing paraffins and naphthenes, without the necessity for solvent extraction. This process comprises catalytically reforming a $C_7$ or $C_8$ full boiling carbon number naphtha feed fraction or combination thereof under reforming conditions of sufficient severity to convert essentially all of the nonaromatic portion of the naphtha feed boiling in the $C_7$ to $C_8$ aromatic boiling range to $C_7$ and/or $C_8$ aromatics, and to produce a reformate having a nonaromatic content such that the aromatic hydrocarbons can be directly recovered from the reformate with a commercially acceptable purity by fractional distillation; and then fractionating the reformate to directly recover the $C_7$ and/or $C_8$ aromatic hydrocarbons in highly pure form.

As used herein, the term "full boiling carbon number naphtha fraction" refers to a naphtha fraction which has an ASTM distillation boiling range sufficient to include substantially all of the paraffins, naphthenes, and aromatic compounds having the same number of carbon atoms per molecule as the $C_7$ and/or $C_8$ aromatics desired to be produced. The present invention thus contemplates employing as the reformer charge feed fraction a $C_7$ or $C_8$ full boiling carbon number naphtha feed fraction or combination thereof. Moreover, the $C_7$ or $C_8$ full boiling carbon number naphtha fraction may also be in admixture with a $C_6$ full boiling carbon number naphtha.

Broadly, applicant has found that $C_7$ and/or $C_8$ aromatic hydrocarbons may be produced in a highly pure form, and in greater yield per volume of petroleum feed than heretofore possible by employing as the reformer charge fraction a $C_7$ and/or $C_8$ full boiling carbon number naphtha, and then reforming this fraction under reforming conditions of ultimately high severities sufficient to convert the nonaromatics contained therein essentially completely to the corresponding $C_7$ and $C_8$ aromatics and to produce a reformate having a minimum of nonaromatic hydrocarbons. The only requirements to successful operation of the instant process, therefore, are that the charge to the reformer system be a $C_7$ and/or $C_8$ full boiling carbon number naphtha, and that the reforming conditions be of ultimately high severity. Naphtha fractions which meet the requirements of the instant invention include the following:

(1) when it is desired to produce high-purity $C_7$ aromatic, a $C_7$ full boiling carbon number naphtha fraction is employed. Naphtha fractions suitable for the production of $C_7$ aromatics include $C_6$ to $C_7$, or $C_7$ naphtha fractions having an ASTM distillation end point of about 250° F.

(2) when a high-purity $C_8$ aromatic product is desired, a $C_8$ full boiling carbon number naphtha fraction is utilized. Naphtha fractions falling within this range include $C_6$ to $C_8$, $C_7$ to $C_8$, and $C_8$ naphtha fractions having an ASTM distillation end point of about 300° to about 360° F., and preferably of about 325° F.

(3) when both a high-purity $C_7$ aromatic fraction and a high-purity $C_8$ aromatic fraction are simultaneously desired to be produced, a $C_7$ and $C_8$ full boiling carbon number naphtha fraction is employed. Naphtha fractions suitable for the production of both a high-purity $C_7$ aromatic fraction and a high-purity $C_8$ aromatic fraction include $C_6$ to $C_8$, and $C_7$ to $C_8$ naphtha fractions having an ASTM distillation endpoint of about 300° F. to about 360° F., and preferably of about 325° F.

The process of the instant invention is particularly efficacious, however, when the naphtha feed fraction comprises a $C_6$ to $C_8$ full boiling carbon number naphtha having an ASTM distillation end point of about 300° F. to about 360° F., and preferably of about 325° F., since the use of such a naphtha fraction allows the simultaneous production of both a high-purity $C_7$ aromatic fraction and a high-purity $C_8$ aromatic fraction, together with a $C_6$ aromatic rich concentrate. Moreover, applicant has found that the instant process is especially efficacious when the $C_7$ and/or $C_8$ full boiling carbon number naphtha is reformed in a plurality of increasingly more severe reforming steps. Accordingly, in the preferred embodiment, the process of the present invention is utilized with a multiple reaction stage reforming system in which the severity of the reforming conditions in each of the reaction stages is increased from the first reaction stage to an ultimately high severity in the last reaction stages. Preferably, also, the naphtha feed fraction comprises a $C_6$ to $C_8$ full boiling carbon number naphtha having an ASTM distillation end point of from 300° to 360° F., and preferably from about 325° F.

Through the use of the process according to the present invention, $C_7$ and $C_8$ aromatic hydrocarbons may be produced in a highly pure form without the necessity for solvent extraction. Moreover, by employing as a reformer charge a relatively broader boiling range nonaromatic material containing fraction than that employed in conventional processes, and then reforming under reforming conditions of heretofore unusable severity, the amount of $C_7$ and/or $C_8$ aromatic hydrocarbons obtainable from each volume of petroleum feed is significantly increased in comparison to conventionally employed processes. Accordingly, the present invention provides a particularly efficacious process for the production of $C_7$ and/or $C_8$ aromatic hydrocarbons, wherein both the purity and yield of these compounds is optimized.

Other objects, features, and advantages of the instant invention will become apparent to the skilled artisan upon examination of the following detailed description of the present invention, taken in conjunction with the figures of drawing.

DETAILED DESCRIPTION OF THE PREFERRED EMBODIMENTS

Figure 1:
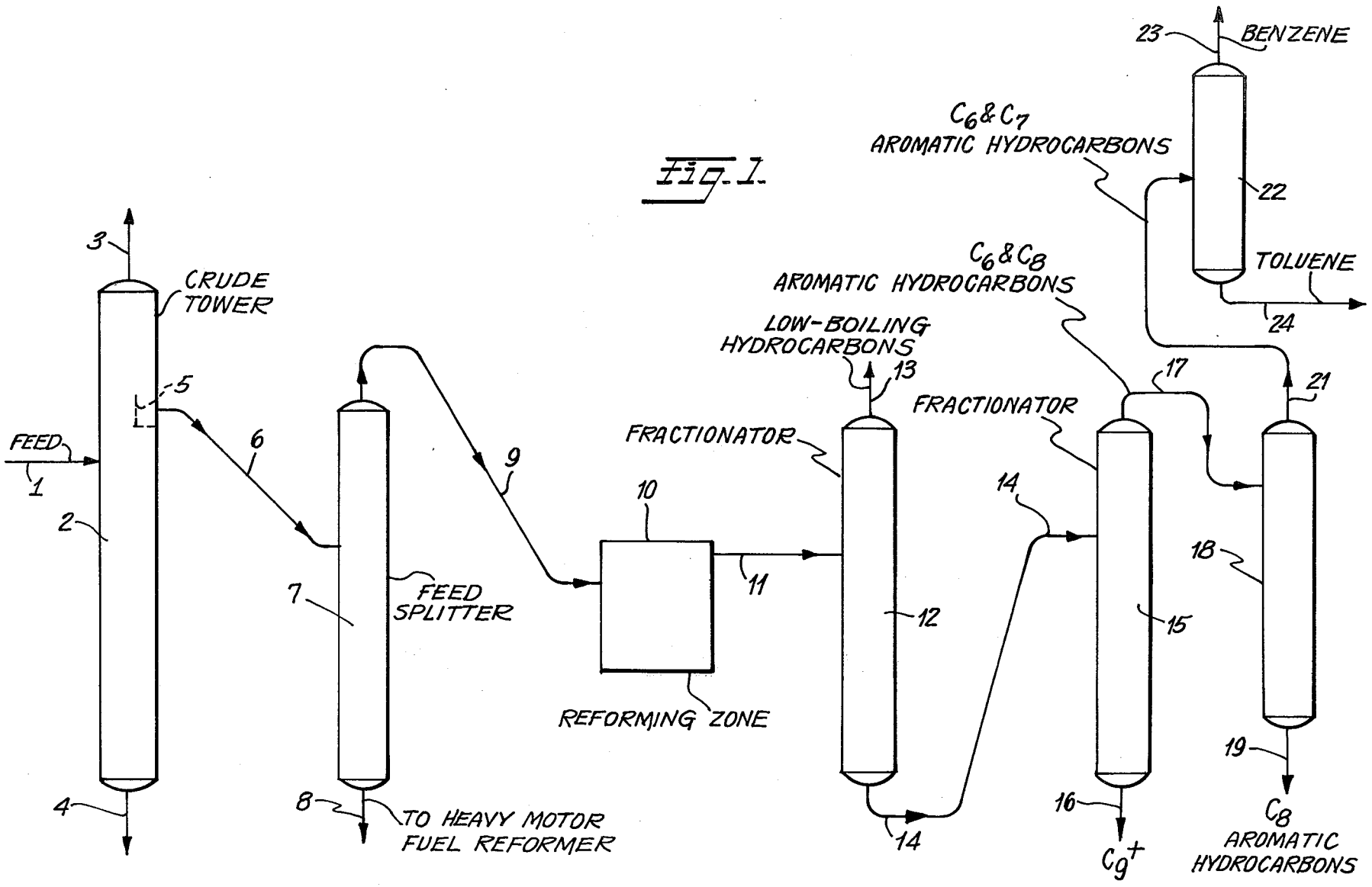
FIG. 1 is a schematic diagram of one embodiment of the process of the instant invention, illustrating one method of fractionating the reformate to recover the individual $C_7$ and $C_8$ aromatic hydrocarbons in highly pure form.

The present invention provides a process for the production of high-purity commercial quality $C_7$ and/or $C_8$ aromatic hydrocarbons in high yield. Heretofore, the presence of nonaromatic hydrocarbons in the reformer charge fraction has prevented the production of these aromatics in highly pure form without a costly solvent extraction step, or without a very low yield. Applicant has found that the problem presented by the presence of nonaromatic hydrocarbons may be overcome by selecting as the reformer charge a naphtha fraction which has a sufficiently broad boiling range to maximize the quantity of available aromatic hydrocarbon precursors convertible into $C_7$ and/or $C_8$ aromatics, and then reforming this reformer charge fraction under reforming conditions of ultimately high severity sufficient to maximize the production of the $C_7$ and/or $C_8$ aromatic hydrocarbons and to minimize the presence of nonaromatic material.

Generally, any $C_7$ and/or $C_8$ full boiling carbon number naphtha, as defined above, is suitable for use in the instant invention. The $C_7$ full boiling carbon number naphtha fractions will typically comprise a $C_6$ to $C_7$, or a $C_7$ naphtha fraction having an ASTM distillation end point of about 250° F. The $C_8$ full boiling carbon number naphtha fractions include the $C_6$ to $C_8$, $C_7$ to $C_8$, or $C_8$ naphtha fractions having an ASTM distillation end point of about 300° F. to about 360° F., and preferably of 325° F. In the preferred embodiment, the full boiling carbon number naphtha fraction comprises a $C_7$ and $C_8$ full boiling carbon number naphtha fraction. Naphtha fractions falling within this boiling range include the $C_6$ to $C_8$, or $C_7$ to $C_8$ naphtha fractions having an ASTM distillation end point of about 300° F. to about 360° F., and preferably of about 325° F., of which the $C_6$ to $C_8$ fraction is most preferred since the use of such a naphtha fraction enables the simultaneous production of both a high-purity $C_7$ aromatic fraction and a high-purity $C_8$ aromatic fraction together with a $C_6$ aromatic rich concentrate, as will be explained more fully hereinafter.

Contrary to the express teachings of U.S. Pat. No. 3,635,815, use of a naphtha fraction having a boiling point in this range does not necessarily yield an aromatic hydrocarbon product with low purity when the reformer charge fraction is reformed under reforming conditions of ultimately high severity sufficient to maximize the conversion of the heavy paraffinic and naphthenic portions of the charge fraction to the corresponding aromatic hydrocarbons. Hitherto, use of such reforming conditions with conventional processes has resulted in the destruction of a significant portion of the aromatic precursors, and consequently a low yield of the corresponding aromatics. In the present invention, however, such reforming conditions may be advantageously utilized, without harm to the aromatic precursors, by employing a reforming system which comprises a plurality of increasingly more severe reforming steps, the last of the reforming steps being under reforming conditions of ultimately high severity.

It will be understood by those skilled in the art that the term $C_7$ and/or $C_8$ aromatic hydrocarbons as used herein refers to aromatic hydrocarbons having 7 and/or 8 carbon atoms per molecule, and includes such aromatic hydrocarbons as toluene and xylenes. As also used herein, the term xylenes refers to the $C_8$ aromatic hydrocarbons in a generic sense and includes para-xylenes, meta-xylenes, ortho-xylenes, and ethylbenzene.

Referring now to the drawings, FIG. 1 illustrates one scheme for the preparation of high-purity $C_7$ and/or $C_8$ aromatic hydrocarbons according to the process of the instant invention. A crude petroleum feed is introduced through line 1 into crude tower 2. The crude tower 2 is of any conventional design and may be such as is found in any typical refinery complex. In the crude tower 2, a naphtha feed fraction is removed via side-cut means 5 and transported to the feed splitter prefractionation zone 7. The naphtha feed fraction may comprise any naphthenic boiling material. However, in the preferred embodiment, the naphtha feed fraction typically comprises a $C_6$-400° F. naphtha fraction. Those skilled in the art will realize that the crude tower 2 could be designed and/or operated so as to produce a $C_6$ to $C_8$ full boiling carbon-number naphtha directly without the necessity of having a feed splitter. However, in the preferred embodiment, a feed splitter is utilized in order to maximize aromatic yield.

The feed splitter 7 is operated so as to produce by fractional distillation a $C_7$ and $C_8$ full boiling carbon number naphtha fraction, comprising a $C_6$ to $C_8$ naphtha fraction having an ASTM distillation end point of about 300° F. to about 360° F., and preferably of 325° F., and to produce a bottoms fraction having a higher end point. Applicant has found that by separating the naphtha feed fraction into an overhead fraction having a boiling range within this temperature range, the yield of $C_6$ to $C_8$ aromatic hydrocarbons per volume of crude petroleum feed can be maximized. A naphtha having such a boiling range contains essentially all of the $C_6$ to $C_8$ aromatic hydrocarbon precursors, while minimizing the concentration of higher boiling paraffins and heavy naphthenes which tend to form carbonaceous deposits on the catalyst, thus shortening the catalyst life between regenerations. The resulting bottoms fraction is removed from the feed splitter 7 through line 8 and transferred to a heavy motor fuel reformer for further use. The full boiling carbon number naphtha overhead fraction having an end point of 320° to 360° F. is then transported through line 9 to a catalytic reforming zone 10.

The reforming zone 10 may comprise any conventional reforming system, capable of operating at a high severity, well known to those skilled in the art, and may include single reactor systems or multiple reactor systems. Moreover, it may also be either an isothermal or an adiabatic reforming system.

While the process of the instant invention is applicable for use with any conventional high severity reforming system, in the preferred embodiment, the reforming zone 10 preferably comprises a multiple reactor adiabatic reforming system. Applicant has found that by employing such a reforming system, the reforming conditions can be tailored to maximize the formation of $C_6$ to $C_8$ aromatic hydrocarbons simultaneously with minimizing the remaining nonaromatic paraffins and naphthenes which boil in the range of the $C_7$ and/or $C_8$ aromatic hydrocarbons. Accordingly, in the preferred embodiment, the reforming zone 10 comprises a high severity adiabatic reforming system containing at least three and preferably four reactor stages, which may be housed either in a single vessel or in multiple vessels as would be obvious to those skilled in the art, and with or without facilities to remove from service a portion of the total catalyst for external regeneration and then to replace the same in service while continuing to operate.

It is a preferred embodiment that, when a multiple reaction stage reforming system is employed, the severity of the reforming conditions is progressively increased from the first through the last reaction stages. In the first stages of the overall reforming reaction, the severity of the reforming condition is lower than the overall average severity in order to favor conversion of naphthenes to their corresponding aromatic hydrocarbons and to allow virtual completion of the naphthene conversion reaction at conditions wherein the relative cracking reaction rates are low. In the latter reaction stages, the severity of the reforming conditions is increased to a severity sufficient to convert substantially all the paraffins to the corresponding aromatics. Therefore, by increasing the severity of the reforming conditions from the first to the last reaction stages, essentially all of the $C_7$ and/or $C_8$ aromatic hydrocarbon precursors are converted to the aromatic before the cracking reaction is initiated and converts the remaining molecules to easily removable components, producing a $C_8$ aromatic product containing less than 1% nonaromatic material and a $C_7$ aromatic product containing less than 5% nonaromatic material. Moreover, the use of at least three and preferably four reaction stages enables the severity of the reforming conditions to be adjusted incrementally so as to provide reforming conditions optimum for each naphthene conversion reaction, thereby maximizing the amount of $C_6$ to $C_8$ aromatic obtainable from each volume of charge.

By thus utilizing a multiple reaction stage reforming system wherein the severity of the reforming conditions progressively increase from the first to the last reaction stages, the reforming process may be operated at heretofore unusable severities without destruction of the $C_6$ to $C_8$ aromatic precursors. By operating at heretofore unusable severities, conversion of the paraffins and naphthenes can be achieved to a higher degree than heretofore possible. Consequently, a broader boiling range reformer charge containing essentially all of the $C_6$ to $C_8$, $C_7$ to $C_8$, or $C_8$ aromatic precursors may be utilized without resulting in the lowering of the $C_7$ and/or $C_8$ aromatic product purity below that which is commercially usable.

Those skilled in the art will know that such operating severities require operation at relatively low pressure and catalyst space velocity, and also require relatively high operating temperatures as well as careful control over the catalyst formulation and other variables of high severity reforming operations. The severity of the reforming conditions may be measured by the temperature at which the reforming zone is maintained provided that other operating conditions are known to be consistent with the high severity operation. Typically, the reforming conditions include a temperature in the range of 800° F. to 1100° F., or more, preferably 900°–1000° F., and a pressure in the range of 50 psig to about 1000 psig or more, and preferably from 100 psig to 200 psig. The reforming zone is also preferably maintained at a liquid hourly space velocity (LHSV) of 0.1 to 20 or more, and preferably in the range of from about 0.5 to 3, cubic feet of feed naphtha per cubic foot of catalyst per hour, and a hydrogen recycle rate in the range of from 1.0 to about 20.0 or more moles of hydrogen per mole of feed naphtha preferably about 5 to 7.0 moles of hydrogen per mole of reformer feed naphtha. Applicant has found that optimum results are obtained when a temperature in the range of about 950° F. to 1000° F. is maintained in the last reaction stages, and a temperature of 850° F. to 900° F. is maintained in the first reaction stages.

Alternatively, the severity of the reforming conditions may be measured by the $C_5$+ reformate target octane number, as described in U.S. Pat. No. 3,635,815, herein incorporated by reference, as would be obvious to those skilled in the art. It should be further apparent to those skilled in the art that the $C_7$ and/or $C_8$ full boiling carbon number naphtha fraction may be passed through the reforming zone in an upward, downward, radial, or plug flow manner.

The reforming operation is also preferably a catalytic operation, and may be conducted with any suitable catalyst which is effective to convert the nonaromatic material contained in the reformer charge fraction to the corresponding aromatic hydrocarbons. The particular reforming catalyst may be any of those well known to the art. Typically, these catalysts comprise at least one platinum group metal on an inorganic refractory support. By way of illustration, but not of limitation, typical examples include platinum-germanium-halogen on alumina catalysts, platinum-halogen on alumina catalysts, platinum-halogen-rhenium on alumina catalysts, and platinum-halogen-iridium on alumina catalysts, or combinations thereof.

After reforming, the $C_6$ or $C_8$ hydrocarbon containing reformate is transported through line 11 to fractionator 12. In fractionator 12 the reformate is separated into a low boiling overhead fraction, which is removed from the system through line 13, and a $C_6$+ bottoms fraction which is fed into fractionator 15 via line 14 for further fractionation. In the fractionator 15, a high-purity $C_6$ to $C_8$ aromatic hydrocarbon overhead is separated from any residual $C_9$+ hydrocarbon product (Line 16) and passed via line 17 into the fractionator 18. In the column 18, high-purity $C_8$ aromatic hydrocarbons, comprising mixed xylenes and ethylbenzene, are removed as a bottoms fraction through line 19. A $C_6$ and $C_7$ aromatic hydrocarbon fraction is removed as an overhead from column 18 through line 21, and subsequently separated by fractional distillation in column 22 to produce a $C_6$ aromatic concentrate overhead fraction through line 23, and a high-purity $C_7$ bottoms fraction through line 24. Typically, the $C_6$ aromatic hydrocarbon fraction will comprise benzene with 40% or less nonaromatic material, while the $C_7$ aromatic hydrocarbon fraction will comprise toluene with an aromatic hydrocarbon purity of greater than 95%.

It is also contemplated within the scope of the instant invention that feed treating means (not shown) may be employed to remove impurities such as sulfur compounds, nitrogen compounds, oxygen compounds, and heavy metal impurities that may be present in a conventional naphtha feed prior to the reforming step.

Figure 2:
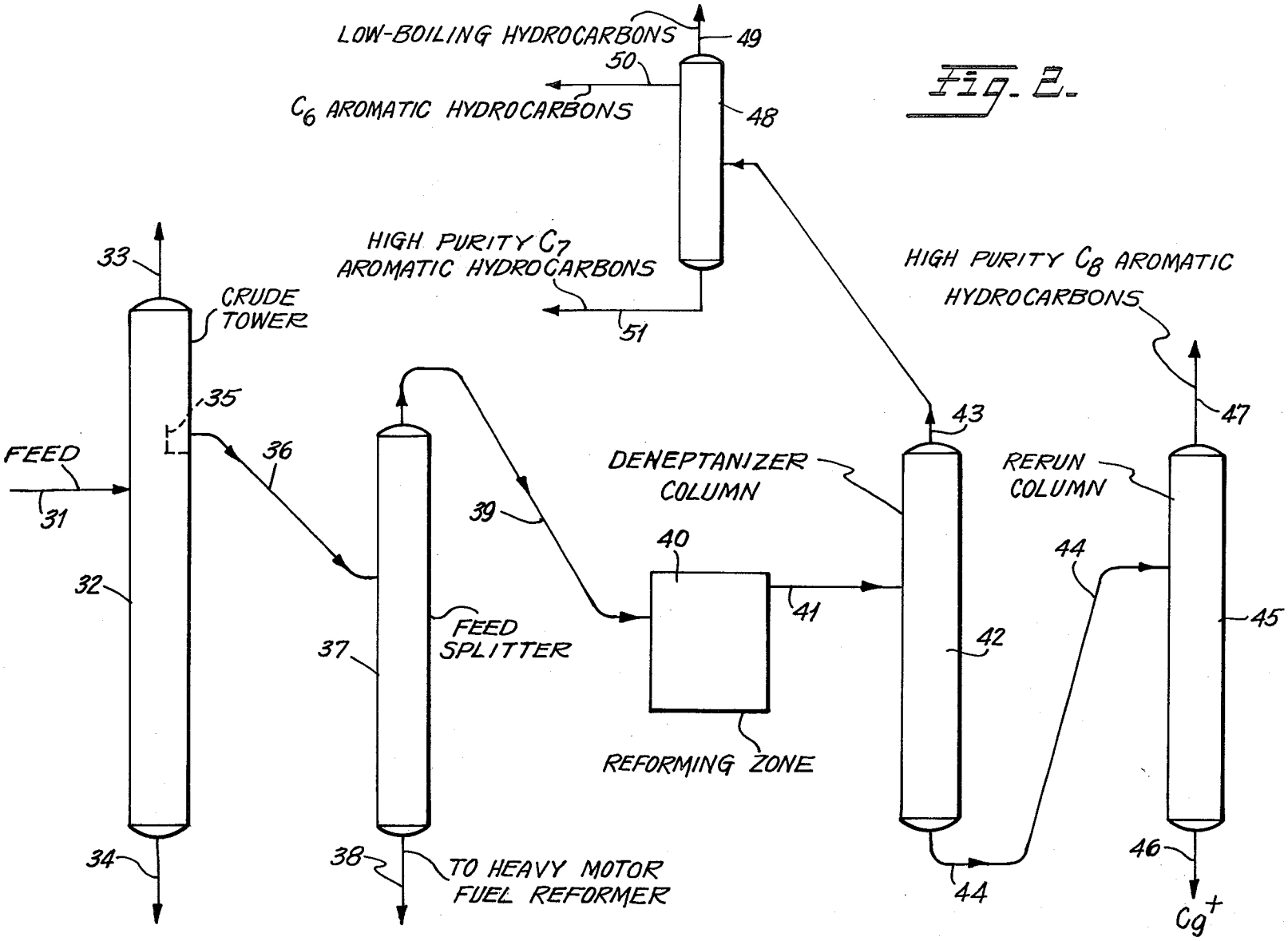
FIG. 2 is a schematic diagram of another embodiment of the instant invention applied to a different scheme for fractionating the reformate to recover the individual $C_7$ and $C_8$ aromatic hydrocarbons in highly pure form.

FIG. 2 illustrates an alternative flow scheme where a different arrangement of fractionation columns is employed to separate the reformate into the individual high purity $C_6$ to $C_8$ aromatic hydrocarbons. Identically to FIG. 1, the petroleum feed is introduced through line 31 to the crude tower 32. In the crude tower 32, a $C_6$-400° F. naphtha feed fraction is removed by sidecut means 35 and transported through line 36 to the feed splitter 37. In the feed splitter, the $C_6$-400° F. naphtha fraction is separated by fractional distillation into a $C_6$ to $C_8$ naphtha fraction having an ASTM distillation end point of 300° F. to 360° F., and preferably of 325° F., and a higher boiling bottoms fraction which is withdrawn through line 38 for further use. This $C_7$ and $C_8$ full boiling carbon number naphtha fraction is then passed through line 39 to the reforming zone 40 where it is preferably reformed in a multiple reaction stage reforming system as has been described above. The resultant $C_6$ to $C_8$ aromatic hydrocarbon containing reformate is then passed through line 41 to the deheptanizer column 42 wherein the reformate is separated into a $C_7$ and lower boiling hydrocarbon fraction and a $C_8$ and higher boiling hydrocarbon fraction. The $C_7$ and lower boiling hydrocarbon fraction is withdrawn as an overhead through line 43 to the fractionator 48. The $C_8$ and higher boiling hydrocarbon fraction is withdrawn as a bottoms through line 44 to the rerun column 45. In the fractionator 48, the $C_7$ and lower boiling hydrocarbon fraction is separated by fractional distillation into a low boiling hydrocarbon overhead, withdrawn through line 49, a $C_6$ aromatic hydrocarbon concentrate sidecut fraction, withdrawn through line 50, and a high-purity $C_7$ aromatic hydrocarbon bottoms fraction through line 51. In the rerun column 45, any residual $C_9$+ hydrocarbons are separated from the $C_8$ aromatic hydrocarbons by fractional distillation and are withdrawn as a bottoms fraction through line 46. The resulting high-purity $C_8$ aromatic hydrocarbons are recovered as an overhead through line 47.

While the instant invention has been described with reference to certain fractionation systems for recovering pure $C_7$ and $C_8$ aromatic hydrocarbons from a $C_6$ to $C_8$ aromatic hydrocarbon containing reformate, it should be obvious to those skilled in the art that any fractionation system may be employed with the process of the invention which enables the $C_7$ and $C_8$ aromatic hydrocarbons to be recovered in pure form. Moreover, it should be noted that when any of the other $C_7$ and/or $C_8$ full boiling carbon number naphtha fractions contemplated by the instant invention are employed as the reformer charge, certain modifications, as would be obvious to those skilled in the art, may be required to enable the $C_7$ and/or $C_8$ aromatic hydrocarbons to be recovered in pure form. Accordingly, the present invention contemplates the use of any fractionation system well known to those skilled in the art whereby the particular aromatic desired to be produced may be recovered in pure form with a high efficiency. By way of example, but not of limitation, in the production of high-purity $C_8$ aromatic from a $C_8$ full boiling carbon number naphtha, such as a $C_8$ naphtha having an ASTM distillation end point of about 325° F., a fractionation system comprising a deheptanizer and a rerun column may be advantageously employed to recover a high purity $C_8$ aromatic hydrocarbon product.

Applicant has found that by utilizing the process of the instant invention, $C_7$ and/or $C_8$ aromatic hydrocarbons, including toluene, and mixed xylenes may be produced with a commercially acceptable purity and with a heretofore unobtainable yield per volume of petroleum feed without the necessity for solvent extraction. High-purity toluene with an aromatic hydrocarbon purity of greater than 95 liquid volume percent can be produced by the instant process without solvent extraction and in a heretofore unobtainable yield, together with the production of high-purity xylenes with less than 1% non-aromatic material. The present invention thus provides a particularly efficacious process for the production of xylenes of greater than 99% purity, and also provides as an additional product, toluene of commercially acceptable purity. Use of the process of the instant invention thus provides a facile and economical method for the production of high-purity $C_7$ and $C_8$ aromatic hydrocarbons, and with a significant increase in yield of the pure aromatic hydrocarbon per volume of petroleum feed. By employing as a reformer charge fraction a $C_7$ and/or $C_8$ full boiling carbon number naphtha fraction which has an ASTM distillation boiling range sufficient to include substantially all the paraffins, naphthenes, and aromatic compounds having the same number of carbon atoms per molecule as the $C_7$ and/or $C_8$ aromatic desired to be produced, and reforming under ultimately high severity, increased yields of aromatic hydrocarbons can be obtained without a decrease in aromatic purity. Moreover, by reforming in a plurality of reaction stages in which the severity of the reforming conditions is progressively increased from the first to the last reaction stages, the purity and yield of the $C_7$ and $C_8$ aromatic hydrocarbons is even more enhanced.

In order to more fully describe the present invention, the following example is presented which is intended to be merely illustrative and not in any sense limitative of the invention.

100,000 barrels of petroleum feed are treated according to the process described in U.S. Pat. No. 3,635,815, and according to the process of the instant invention wherein a $C_7$ and $C_8$ full boiling carbon number naphtha fraction comprising a $C_6$ to $C_8$ naphtha having an ASTM distillation end point of about 325° F. is reformed at a temperature of 950° to 975° F. in a four-reactor adiabatic reforming system, using a conventional reforming catalyst. Comparison of the two processes reveals that a significantly greater amount of high-purity xylenes are produced per 100,000 barrels of petroleum feed according to the process of the instant invention than that obtained by use of the process described in U.S. Pat. No. 3,635,815.

It is thus seen from this example that, by employing as a reformer charge a $C_7$ and/or $C_8$ full boiling carbon number naphtha fraction, containing essentially all of the hydrocarbons convertible into $C_7$ and $C_8$ aromatics, and then reforming with a heretofore unusable severity, a significant increase in yield and purity of $C_7$ and $C_8$ aromatic hydrocarbons is accrued over that obtained with conventional processes for the production of these compounds.

While the invention has been described in terms of various preferred embodiments and illustrated by numerous examples, the skilled artisan will appreciate that various modifications, substitutions, omissions and changes may be made without departing from the spirit thereof. Accordingly, it is intended that the scope of the present invention be limited solely by the scope of the following claims.

What is claimed is:

1. A process for the production by reforming of high-purity commercial quality aromatic hydrocarbons, selected from the group consisting of $C_7$, $C_8$, or $C_7$ and $C_8$ aromatic hydrocarbons, from a full boiling $C_7$–$C_8$ naphtha fraction without the use of prefractionation of the naphtha fraction or solvent extraction or clay treatment of the reformate, consisting essentially of the steps of:

(a) providing a starting material determined as follows: (i) for the production of high-purity $C_7$ aromatic, a $C_7$ full boiling carbon number naphtha fraction; (ii) for the production of high-purity $C_8$ aromatic, a $C_8$ full boiling carbon number naphtha; (iii) for the production of high-purity $C_7$ and $C_8$ aromatic hydrocarbons, a $C_7$ and $C_8$ full boiling carbon number naphtha fraction;

(b) catalytically reforming said starting material under reforming conditions of sufficient severity to convert the nonaromatic present therein essentially completely to the corresponding aromatic and to produce a reformate having a nonaromatic content such that said $C_7$ aromatic hydrocarbons can be directly recovered from said reformate with purity of greater than about 95 liquid volume percent and said $C_8$ aromatic hydrocarbons can be directly recovered from said reformate with a purity of greater than about 99 liquid volume percent, by fractional distillation; and (c) fractionating said reformate to directly recover said aromatic hydrocarbons in highly pure form.

2. The process of claim 1, wherein said $C_7$ full boiling carbon number fraction is a $C_6$ to $C_7$ naphtha fraction having an ASTM distillation end point of about 250° F.

3. The process of claim 1, wherein said $C_7$ full boiling carbon number naphtha fraction is a $C_7$ naphtha fraction having an ASTM distillation end point of about 250° F.

4. The process of claim 1, wherein said $C_8$ full boiling carbon number naphtha fraction comprises a $C_6$ to $C_8$ naphtha fraction having an ASTM distillation end point of about 300° F. to about 360° F.

5. The process of claim 1, wherein said $C_8$ full boiling carbon number naphtha fraction comprises a $C_7$ to $C_8$ naphtha fraction having an ASTM distillation end point of about 300° F. to about 360° F.

6. The process of claim 1, wherein said $C_8$ full boiling carbon number naphtha fraction comprises a $C_8$ naphtha fraction having an ASTM distillation end point of about 300° F. to about 360° F.

7. The process of claim 1, wherein said starting material comprises a $C_7$ and $C_8$ full boiling carbon number naphtha fraction.

8. The process of claim 7, wherein said $C_7$ and $C_8$ full boiling carbon number naphtha fraction comprises a $C_7$ to $C_8$ naphtha fraction having an ASTM distillation end point of about 300° F. to about 360° F.

9. The process of claim 7 wherein said $C_7$ and $C_8$ full boiling carbon number naphtha fraction comprises a $C_6$ to $C_8$ naphtha fraction having an ASTM distillation endpoint of about 300° F. to about 360° F.

10. The process of claim 9 wherein said $C_7$ and $C_8$ aromatic hydrocarbons are recovered in highly pure form by fractionating said reformate into a low-boiling hydrocarbon fraction and a $C_6$+ bottoms fraction; fractionating said bottoms fraction into a $C_6$ to $C_8$ aromatic hydrocarbon containing overhead fraction, and a $C_9$+ hydrocarbon fraction; and separating said $C_6$ to $C_8$ aromatic hydrocarbon containing overhead fraction into said individual $C_7$ and $C_8$ aromatic hydrocarbons by fractional distillation.

11. The process of claim 9 wherein said $C_7$ and $C_8$ aromatic hydrocarbons are recovered in a highly pure form by fractionating said reformate into a $C_7$ and lower boiling hydrocarbon fraction and a $C_8$ and higher boiling hydrocarbon fraction; separating said $C_8$ and higher boiling hydrocarbon fraction into a $C_8$ hydrocarbon fraction of high purity and a $C_9$+ hydrocarbon fraction; separating said $C_7$ and lower boiling hydrocarbon fraction into a low boiling fraction, and a $C_6$ and higher aromatic hydrocarbon fraction; separating said $C_6$ and higher boiling hydrocarbon fraction into a $C_6$ hydrocarbon fraction and a high-purity $C_7$ aromatic hydrocarbon fraction; and recovering said high-purity $C_7$ and $C_8$ aromatic hydrocarbon fractions as the products of said process.

12. The process of claim 9, wherein said starting material is reformed in a plurality of increasingly more severe reforming stages.

13. The process of claim 12, wherein said starting material is reformed in a reforming system containing at least three reforming stages.

14. The process of claim 1, wherein said reforming conditions comprise an operating temperature of from about 800° F. to about 1100° F., a pressure of from about 50 psig to about 1000 psig, a liquid hourly space velocity of from about 0.1 to about 20 cubic feet of naphtha feed per cubic foot catalyst per hour, and a hydrogen recycle rate in the range of from about 1 to about 20 moles of hydrogen per mole of reformer feed naphtha.

15. The process of claim 13, wherein, in the first reforming stage, the severity of the reforming conditions in lower than the overall average severity of the reforming conditions in all of the reforming stages, whereby conversion of naphthenes to their corresponding aromatic hydrocarbons is favored and essential completion of the naphthene conversion takes place under conditions wherein the relative cracking reaction rates are low, and in the last reforming stage, the severity of the reforming conditions is increased to a severity sufficient to convert substantially all of the paraffins to their corresponding aromatic compounds.

16. The process of claim 15, wherein the operating temperature in the last reforming steps is about 950° F. to about 1000° F., and in the first reforming step is within the range of from about 850° F. to about 900° F.

17. The process of claim 15, including four reforming stages of increasing severity.

* * * * *